US009878333B2

(12) United States Patent
Seery

(10) Patent No.: US 9,878,333 B2
(45) Date of Patent: Jan. 30, 2018

(54) WELD BALL COLLECTION IN A PHOSPHATE SYSTEM

(71) Applicant: Lloyd M Seery, Clarkston, MI (US)

(72) Inventor: Lloyd M Seery, Clarkston, MI (US)

(73) Assignee: FCA US LLC, Auburn Hills, MI (US)

( * ) Notice: Subject to any disclaimer, the term of this patent is extended or adjusted under 35 U.S.C. 154(b) by 102 days.

(21) Appl. No.: 15/097,346

(22) Filed: Apr. 13, 2016

(65) Prior Publication Data

US 2017/0297034 A1 Oct. 19, 2017

(51) Int. Cl.
*B03C 1/02* (2006.01)
*C23C 22/60* (2006.01)

(52) U.S. Cl.
CPC ..... *B03C 1/02* (2013.01); *C23C 22/60* (2013.01); *B03C 2201/18* (2013.01); *B03C 2201/20* (2013.01)

(58) Field of Classification Search
CPC ... B03C 1/02; B03C 2201/18; B03C 2201/20; C23C 22/60
See application file for complete search history.

(56) References Cited

U.S. PATENT DOCUMENTS 8,287,709 B2 * 10/2012 Hagihara ..... B05C 3/09 204/512
2005/0211275 A1 9/2005 Wang et al.
2008/0053832 A1 3/2008 Emmonds et al.
2015/0328644 A1 * 11/2015 Newman ..... B03C 1/24 210/695

FOREIGN PATENT DOCUMENTS

DE 10234156 A1 2/2004
JP H1161469 A 3/1999
JP 2004018874 A 1/2004

OTHER PUBLICATIONS

International Search Report and Written Opinion dated Jul. 18, 2017 for International Application No. PCT/US2017/026491, International Filing Date Apr. 7, 2017.

* cited by examiner

*Primary Examiner* — David A Reifsnyder
(74) *Attorney, Agent, or Firm* — Ralph E. Smith

(57) ABSTRACT

Weld balls disposed in solutions in full immersion tanks of a phosphate system are collected by magnets attached to at least some of the hangers that carry skids through stages of the phosphate system. The magnet attached to a hanger is immersed in the solutions when the hanger is immersed in the solutions and magnetically attracts the weld balls.

6 Claims, 4 Drawing Sheets

PRIOR
ART

WELD BALL COLLECTION IN A PHOSPHATE SYSTEM

The present invention relates to the collection of weld balls in full immersion dip tanks of a phosphate system.

BACKGROUND

Phosphate systems are used to pre-treat steel parts and assemblies of steel parts before they are painted. For example, phosphate systems are used in automotive assembly to pre-treat a vehicle sub-assembly commonly known as a body-in-white before it is painted. Such phosphate systems typically have a series of sprays and full immersion dips that the body-in-white passes through. A typical phosphate treatment for a body-in-white involves cleaning, rinsing, surface activation, phosphating, rinsing, a neutralizing rinse, drying and the application of supplemental coatings.

FIG. 1 is a simplified diagram of an eight stage prior art phosphate system 100 of the type used in the automotive industry. There is an entry transfer station 102 at an entry side 104 of the phosphate system 100 and an exit transfer station 106 at an exit side 108 of phosphate system 100. Phosphate system 100 includes a plurality of spray stages 110, 112, 114, 116 and a plurality of full immersion dip stages 118, 120, 122, 124, 126. Each full immersion dip stage 118, 120, 122, 124 includes a full immersion dip tank 127 containing a solution that is recirculated by a pump (not shown) through a filter (not shown). Full immersion dip stage 118 is a cleaning stage with its full immersion dip tank 127 containing a cleaning solution 119, full immersion dip stage 120 is a conditioner stage with its full immersion dip tank 127 containing a conditioner solution 121, full immersion dip stage 122 is a zinc phosphate stage with its full immersion dip tank 127 containing a zinc phosphate solution 123, full immersion dip stage 124 is a city water rinse stage with its full immersion dip tank 127 containing a rinse solution that is city water, and full immersion dip stage 126 is a deionized water rinse and conditioner stage with its full immersion dip stage containing a deionized water and conditioner solution 129. Spray stages 110, 112, 114, 116 are water spray rinse stages.

A metal structure 128, for example a body-in-white 130, is conveyed to entry transfer station 102 where it is placed on a skid 132 and the skid hung on a plurality of hangers 134, typically one hanger 134 at each corner of the skid 132. The hangers are attached to an overhead conveyer (not shown) that lowers and raises the hangers to lower and raise the skid as applicable as it progresses through phosphate system to dip the body-in-white in the full immersion dip tanks. After the skid progresses through the phosphate system 100, the body-in-white is removed from the skid at exit transfer station 106. While only one skid 132 is shown in FIG. 1, it should be understood that there are a number of skids 132 hung on respective hangers 134 that in sequence carry respective metal structures 128 through phosphate system 100 with each skid 132 carried by respective hangers 134 following a preceding skid 132 carried by respective hangers 134.

With reference to FIG. 2, an example of hanger 134 is shown. Hanger 134 has a shaft 200 that attaches at an upper end 202 of shaft 200 to an overhead conveyor (not shown). A lower end 204 of shaft 200 attaches to the skid 132. In an example, hanger 134 has a hook 206 that hooks onto the skid 132. In an aspect, the hook 206 is attached to lower end 204 of hanger 134 and in another aspect, lower end 204 is formed with a hook shape to provide hook 206. A typical hanger 134 as shown in the example of FIG. 2 is J-shaped and is commonly known as a J-hook. It should be understood in other aspects, hanger 134 has shapes other than a J-shape, for example shaft 200 having a C-shaped hook at its lower end 204 or lower end 204 being formed in a C-shape.

During welding of metal structure 128 such as body-in-white 130, weld balls 136 are produced and loosely adhere to surfaces of the metal structure, typically in weld seams and in other crevices. While the weld balls 136 can typically be cleaned off the surfaces of the exterior of the metal structure before the metal structure enters phosphate system 100, it is more difficult to clean the weld balls 136 that are in the interior of the metal structure 128, such as in the interior of body-in-white 130. As the metal structure 128 progresses through phosphate system 100, weld balls 136 fall off. Weld balls 136 disposed in the solutions can be deposited on surfaces of the metal structure 128, typically on surfaces of metal structures subsequently passing through the full immersion dip tanks. If weld balls 136 remain on surfaces of the metal structure 128 when it is painted, they cause blemishes in the painted surface of the metal structure 128.

The solutions used in the full immersion dip tanks are recirculated and pass through filters which filter debris that may be suspended in the solutions. While these filters remove some of the weld balls 136, they do not remove all of them. They typically reduce the concentration of weld balls 136 making it less likely that a weld ball will be deposited on a surface of the metal structure as it is being dipped in a full immersion tank. However, with use, the filters become increasingly clogged and are less effective in removing weld balls 136. The filters are thus periodically cleaned and also periodically replaced. As can be appreciated, as time elapses from the time a filter is cleaned or replaced, the more likely it will be that the fewer weld balls 136 will be removed. The weld balls 136 are also the main source of debris that fills up the filters, reducing the cycle that the filters can be used without cleaning or replacing.

SUMMARY

In accordance with an aspect of the present disclosure, a method of collecting weld balls disposed in solutions in full immersion tanks of a phosphate system in which skids on which metal structures are receivable are carried by hangers through stages of the phosphate system includes having magnets attached to sections of at least some of plurality of hangers. The skids are carried through stages of the phosphate system by the hangers. When a skid having a hanger to which a magnet is attached is immersed in a solution of a full immersion tank, the section of the hanger to which the magnet is attached is also immersed which immerses the magnet and the magnet collects weld balls disposed in that solution by magnetically attracting the weld balls to the magnet.

In an aspect, all the hangers have an attached magnet, with the magnet attached to the section of the respective hanger. In an aspect, each section has a plurality of magnets attached to it.

BRIEF DESCRIPTION OF THE DRAWINGS

The present invention will become more fully understood from the detailed description and the accompanying drawings, wherein.

DETAILED DESCRIPTION

Figure 1:
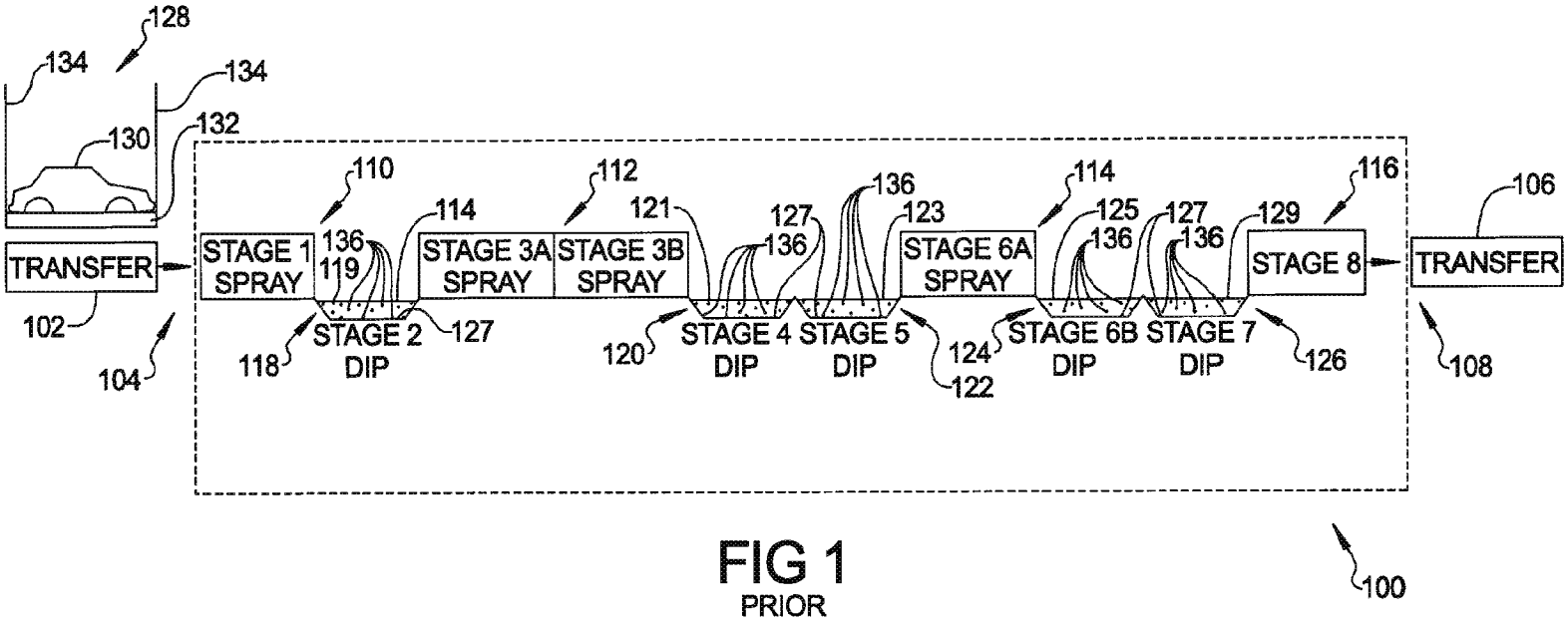
FIG 1 PRIOR ART
FIG. 1 is a simplified block diagram of a prior art phosphate system.
Figure 2:
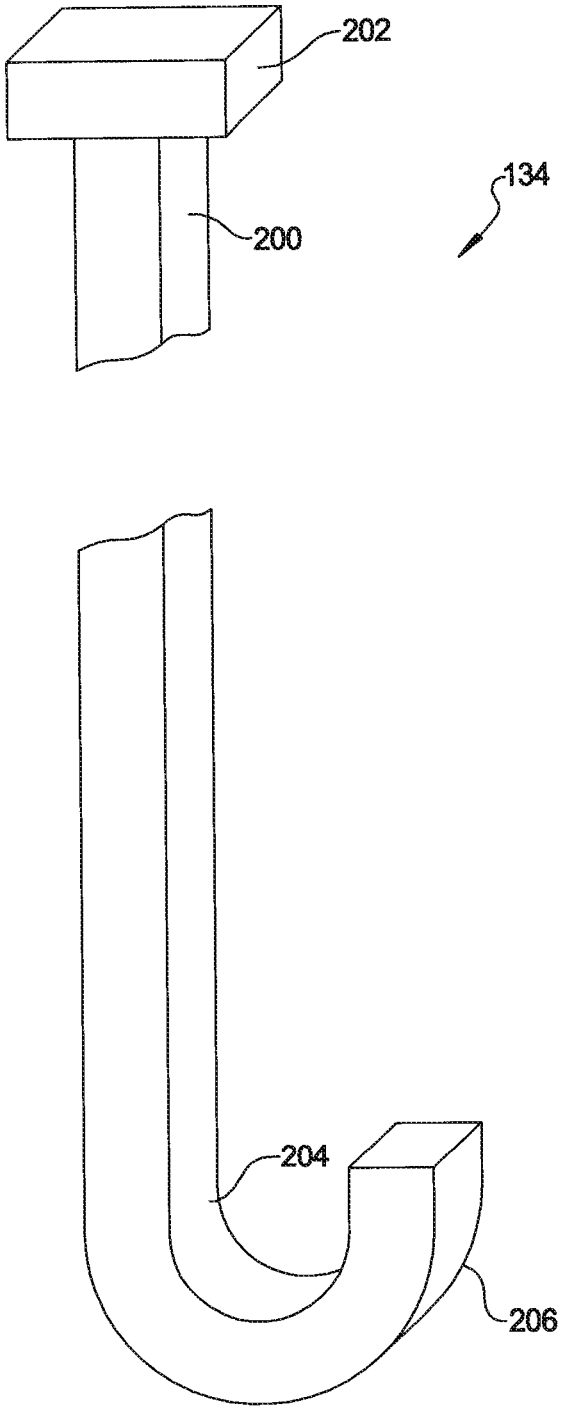
FIG. 2 is a perspective view of a prior art hanger used in the phosphate system of FIG. 2.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

Figure 3:
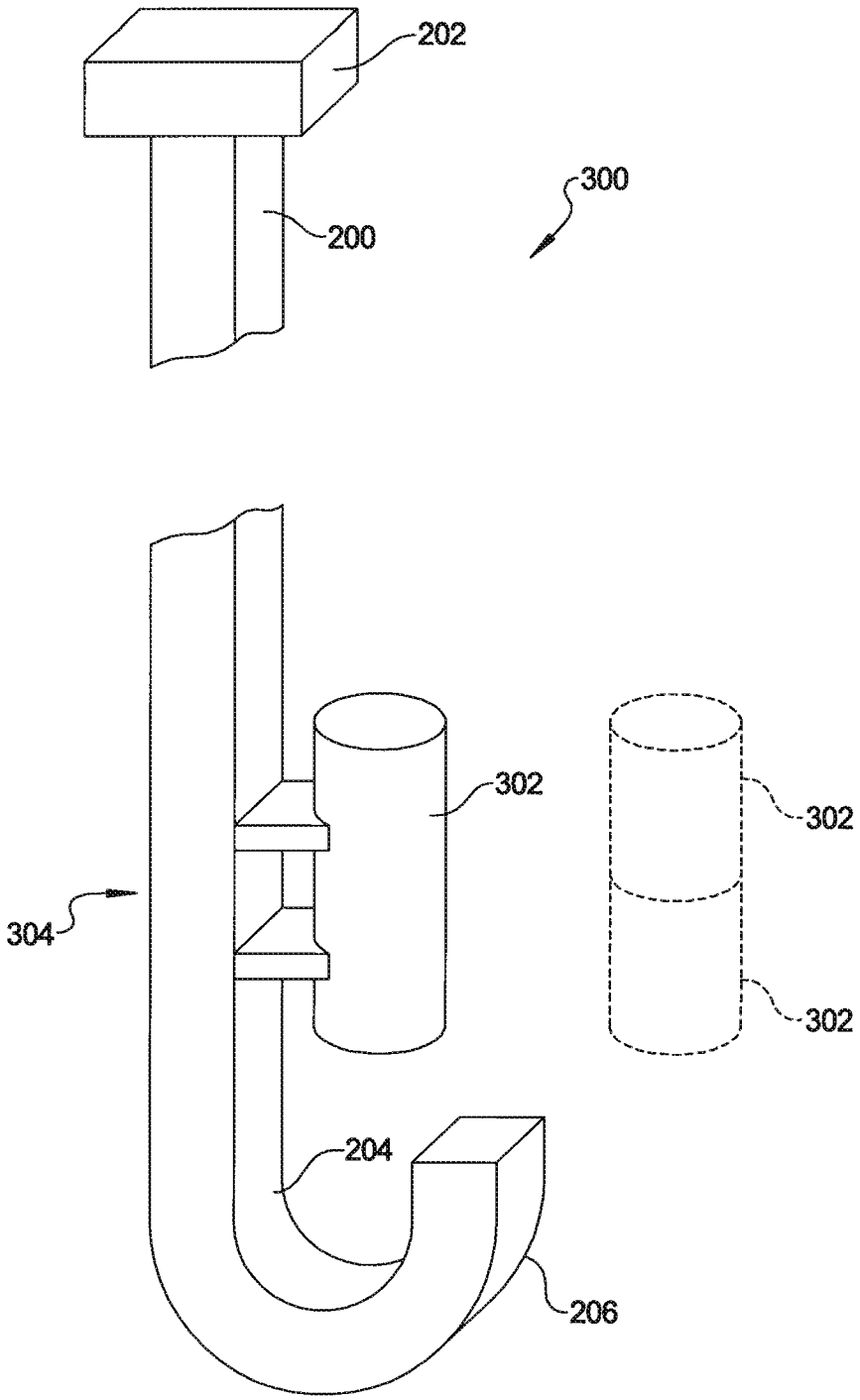
FIG. 3 is a perspective view of a hanger having a magnet attached thereto in accordance with an aspect of the present disclosure.
Figure 4:
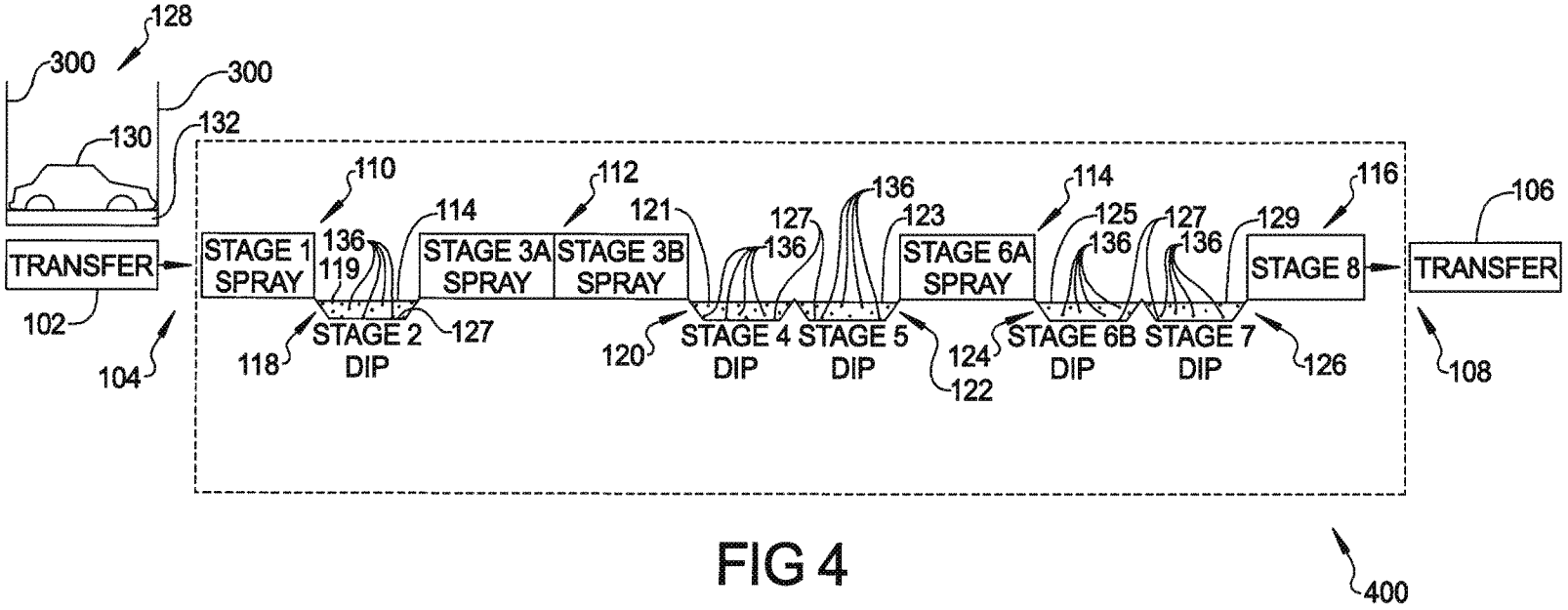
FIG. 4 is a simplified diagram of a phosphate system in which the hanger of FIG. 3 is used.

With reference to FIG. 3, an example of a hanger 300 in accordance with an aspect of the present disclosure is shown. At least a plurality of hangers 300 are used in a phosphate system 400 instead of hanger 134. With the exception of the differences discussed below, hanger 300 is the same as hanger 134, phosphate system 400 is the same as phosphate system 100 and like reference numbers identify like elements. Hanger 300 has at least one magnet 302 attached to shaft 200. In an aspect, each magnet 302 is a 20" long solid cylinder having a 1" diameter and each hanger 300 having a magnet 302 has one magnet 302 attached to section 304 of shaft 200. In an aspect, each hanger 300 having a magnet 302 attached thereto has a plurality magnets 302 attached thereto, shown in phantom in FIG. 3. In this aspect, magnets 302 are illustratively shorter than 20" long. For example, in this aspect magnets 302 are 10" long solid cylinders having 1" diameters with two such shorter magnets attached to section 304 of shaft 200. Magnets 302 are illustratively rare earth magnets such as neodymium magnets. Each magnet 302 is attached to a section 304 of shaft 200 of hanger 300 that is immersed in the solutions in the full immersion dip tanks when the skid 132 carried by that hanger 300 is immersed in the full immersion dip tanks.

In phosphate system 400, the hangers used to carry skids 132 through phosphate system 400 include at least a plurality of hangers 300 with the remaining hangers being hangers 134. In an aspect, all the hangers used in phosphate system 400 are hangers 300.

In operation, each skid 132 is immersed in the solution of each full immersion dip tank 127 when it reaches the stage of phosphate system 400 having that full immersion dip tank 127. When that skid 132 is immersed in the solution of one of the full immersion dip tanks, if a hanger 300 is being used to carry that skid, section 304 of shaft 200 of that hanger is also immersed in the solution as is the magnet 302 attached to section 304. Magnet 302 attracts weld balls 136 that are disposed in the solution of that full immersion dip tank 127 which adhere to the magnet 302. The weld balls 136 are periodically cleaned off the magnet 302 after the hanger 300 is out of phosphate system 400. In an aspect, the weld balls 136 are cleaned from magnets 302 each time the hangers 300 exit phosphate system 400, such as at exit transfer station 106.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of collecting weld balls disposed in solutions in a plurality of full immersion tanks of a phosphate system in which a plurality of skids on which respective metal structures are receivable are carried by a plurality of hangers through a plurality of stages of the phosphate system including the plurality of full immersion tanks having solutions, comprising:

providing each of at least some of the plurality of hangers with a respective attached magnet, each of the at least some of the plurality of hangers having the magnet attached to a section of that hanger;

carrying the plurality of skids through the plurality of stages of the phosphate system including the plurality of full immersion tanks with solutions with the plurality of hangers including immersing the plurality of skids and the sections of the at least some of the plurality of hangers having attached magnets in the solutions in the plurality of full immersion tanks; and collecting the weld balls with the magnets attached to the sections of the at least some of the plurality of hangers having attached magnets by magnetically attracting the weld balls to the magnets.

2. The method of claim 1 further comprising:

providing all of the plurality of hangers with a respective attached magnet, each of all of the plurality of hangers having the magnet attached to the section of that hanger.

3. The method of claim 2 further comprising;

providing all of the plurality of hangers with at least one more respective attached magnet, each of all of the hangers having the at least one more magnet attached to the section of that hanger.

4. A phosphate system, comprising:

a plurality of stages including a plurality of full immersion tanks having solutions therein;

a plurality of skids on which respective metal structures are receivable;

a plurality of hangers that carry the plurality of skids through the plurality of stages of the phosphate system including the plurality of full immersion tanks having solutions and immerse the plurality of skids in the solutions in the plurality of full immersion tanks; and each of at least some of the plurality of hangers having a respective attached magnet ,each of the at least some of the plurality of hangers having the magnet attached to a section of that hanger that is immersed in the solution of each full immersion tank when the skid carried by that hanger is immersed in the solution of that full immersion tank wherein the magnet collects weld balls disposed in the solution by magnetically attracting the weld balls to the magnet.

5. The phosphate system of claim 4 wherein all the plurality of hangers have a respective attached magnet, each of all of the plurality of hangers having the magnet attached to the section of that hanger that is immersed in the solution of each full immersion tank when the skid carried by that hanger is immersed in the solution of that full immersion tank.

6. The phosphate system of claim 5; wherein the section of each hanger having the attached magnet has at least one more attached magnet.

* * * * *